US011492739B2

(12) United States Patent
Crevits et al.

(10) Patent No.: US 11,492,739 B2
(45) Date of Patent: Nov. 8, 2022

(54) TUFTING MACHINE

(71) Applicant: VANDEWIELE NV, Kortrijk (BE)

(72) Inventors: Domien Crevits, Lichtervelde (BE); Vincent Lampaert, Vichte (BE)

(73) Assignee: VANDEWIELE NV, Marke (BE)

( * ) Notice: Subject to any disclaimer, the term of this patent is extended or adjusted under 35 U.S.C. 154(b) by 55 days.

(21) Appl. No.: 16/975,976

(22) PCT Filed: Feb. 27, 2019

(86) PCT No.: PCT/EP2019/054865

§ 371 (c)(1),
(2) Date: Aug. 26, 2020

(87) PCT Pub. No.: WO2019/166490

PCT Pub. Date: Sep. 6, 2019

(65) Prior Publication Data

US 2021/0040664 A1 Feb. 11, 2021

(30) Foreign Application Priority Data

Feb. 27, 2018 (GB) ..... 1803199

(51) Int. Cl.
*D05C 15/10* (2006.01)
*D05C 15/20* (2006.01)

(52) U.S. Cl.
CPC ..... *D05C 15/10* (2013.01); *D05C 15/20* (2013.01)

(58) Field of Classification Search
CPC ..... D05C 15/08; D05C 15/10; D05C 15/12; D05C 15/20
See application file for complete search history.

(56) References Cited

U.S. PATENT DOCUMENTS 2,911,931 A * 11/1959 Johnson ..... D05B 73/12 112/260
3,547,058 A 12/1970 Brown
(Continued)

FOREIGN PATENT DOCUMENTS

GB 2385604 8/2003

OTHER PUBLICATIONS

The International Search Report issued by the European Patent Office dated Apr. 3, 2019 for parent PCT application No. PCT/EP2019/054865; 3 pages.
(Continued)

*Primary Examiner* — Nathan E Durham
(74) *Attorney, Agent, or Firm* — Smith Gambrell & Russell LLP

(57) ABSTRACT

A tufting machine comprising a plurality of needle holders (11) associated with a needle bar (5) and slidably supported in a frame for reciprocation in a needle reciprocation direction. A respective needle (10) is attached to each needle holder (11), each needle holder having an engagement portion. The needle bar (5) has means (7, 13) for selectively latching with the engagement portion of each selected needle holder so as to selectively drive latched needle holders in the needle reciprocation direction. A stop bar (21) is positioned to limit the upward movement of the needle holders (11). At least one magnet (20) retains non-latched needle holders in its uppermost position as the needle bar is reciprocated. The magnets (20) are embedded in the stop bar (21). The machine further comprises a cushioning member (27) attached to the magnet (20) and facing the top of each needle holder (11).

12 Claims, 5 Drawing Sheets

(56) References Cited

U.S. PATENT DOCUMENTS

| | | | | | |
|---|---|---|---|---|---|
| 4,815,402 | A | | 3/1989 | Price | |
| 4,860,674 | A | | 8/1989 | Slattery | |
| 4,966,089 | A | * | 10/1990 | Hanyu | D05B 73/00 112/258 |
| 5,526,761 | A | * | 6/1996 | Mulcahey | D05B 27/04 112/314 |
| 5,590,614 | A | * | 1/1997 | Murata | D05B 29/02 112/237 |
| 2010/0126399 | A1 | * | 5/2010 | Cerliani | D05B 57/14 112/231 |
| 2011/0239921 | A1 | * | 10/2011 | Mack | D05C 9/04 112/103 |
| 2015/0059632 | A1 | * | 3/2015 | Amakawa | D05C 9/04 112/103 |

OTHER PUBLICATIONS

The Combined Search and Examination Report under Sections 17 and 18(3) dated Jul. 30, 2018 for priority application No. GB1803199.7; 6 pages.

* cited by examiner

TUFTING MACHINE

The present invention relates to a tufting machine. In particular, the present invention relates to a tufting machine which has individual needle control. Such a machine is disclosed in GB2385604.

This discloses a tufting machine with reciprocating needle bar to which a plurality of needles can be selectively latched. This is done by having each of the needles supported on a needle holder which is a flat plate which is arranged to be slidable in the direction of reciprocation of needle. The needle holder is supported in a frame to maintain it in the correct plane during the sliding operation. A plurality of latches are selectively deployable in order to latch the needle holder (corresponding a selected needle) to the needle bar so that as the needle bar reciprocates, the needle is driven into the backing material in order to form a stitch.

The needle bar slides laterally such that a tufting machine has the ability to align different colour yarns with different sites on the backing material and select the required yarn using the above mentioned latching arrangement when the colour of yarn required by the pattern is presented at the site.

In the arrangement of GB2385604, each of the needle holders is biased upwardly by a spring. This will hold an unlatched needle holder in its uppermost position when the needle bar is reciprocated to reciprocate the latched needles. The spring surrounds a shaft which is rigidly connected with respect to the needle holder and which is supported in the frame.

This suffers from a number of drawbacks. The spring is sensitive to pollution and dust and therefore requires regular maintenance. There is friction between the spring and the shaft which can cause damage to the shaft.

An alternative arrangement is disclosed in U.S. Pat. No. 4,815,402. In this case, in place of the spring, magnets are provided in order to hold the non-latched needle holder in its uppermost position as the needle bar is reciprocated.

As far as we are aware, no machine was ever produced according to this design. Further, since this application as filed over 30 years ago, the speed of a tufting machine has increased significantly such that the machine of U.S. Pat. No. 4,815,402 does not represent a design which can be used, in practice, on a modern day tufting machine.

The present invention is aimed at providing such a machine.

According to the present invention there is provided a tufting machine according to claim 1.

The present invention improves in U.S. Pat. No. 4,815,402 by embedding the or each magnet in the stop bar. In U.S. Pat. No. 4,815,402, there are a pair of stop bars which are narrower than the magnet to which the magnets are attached. Thus, there will be frequent collisions between the needle holders and the stop bars which occur in a highly irregular and asymmetric manner which will tend to cause vibration and distortion in the very small needle bars. In contrast, by embedding the magnets in a stop bar, the mass of the stop bar is significantly increased thereby ensuring that the effect of any collisions is far less significant in terms of any vibration and distortion of the stop bar than in U.S. Pat. No. 4,815,402.

Further, the present invention provides a cushioning member attached to the magnet facing the top of each needle bar. Such a cushioning member is able to further reduce the effect of any impact.

There is therefore a synergy between the cushioning member and the embedded magnet in that any impact caused by a needle holder is initially at least partially absorbed by the cushioning member. Any effect of the impact which reaches the stop bar will have a far less marked effect on the stop bar for the reasons set above.

There may be a plurality of magnets such that each needle holder is associated with a respective magnet. However, preferably, each magnet is associated with the plurality of needle holders. There could be a single strip running across the entire width of the tufting machine. However, preferably, each magnet is provided by a plurality of elongate strips arranged end to end. There will inevitably be a small gap between adjacent strips. If the strips have a rectangular shape, these gaps will be in a plane parallel to the direction in which the backing material is fed through the machine. If a needle holder is aligned with this gap, the magnetic force retaining that holder will be significantly reduced. Therefore, preferably, at least one end of at least strip is arranged at least partially outside a plane parallel to the direction in which the backing material is fed through the machine and wherein an adjacent end of an adjacent strip has a complementary configuration. In practice, this requires the strips to have ends which are, at least, in part, not perpendicular to their sides. This arrangement ensures that, because the gap is not fully parallel to the direction in which the backing material is fed through the machine, it can never be fully aligned with a single needle holder. In other words, even if a needle holder is aligned with a gap, the gap will pass across the needle holder such there is always a significant amount of magnet in direct alignment with the needle holder.

Each of the strips may have a shape at one end which is different the shape at the other end provided that the two shapes are complementary. However, preferably, each of the elongate strips is the same shape such that, for example having oblique face at either end such that each of the strips is parallelogram. Such a strip is easy to form and fit together.

The magnet may be fully embedded and even covered by a thin portion of the stop bar material. It may also be partially embedded such that a portion of the magnet protrudes from the stop bar. However, preferably, the surface of the or each magnet is flush with the surface of the stop bar. This is easy to manufacture in that the stop bar is provided with one or more grooves within which the magnet is fitted. This can then be covered with the cushioning member which can also be attached to the flush face of the stop bar. Further, when a force is transmitted through the cushioning member, this will be distributed across both the magnet and the stop bar.

The needle holders are preferably arranged in two rows and the stop bar spans the two rows. This gives the stop bar an increased mass and further assists in absorbing and balancing any impacts on the stop bar.

Preferably the needles are arranged in a line defining a needle plane and wherein alternate needle holders extend in opposite directions from the needle plane. Such a staggered arrangement is particularly suitable for relatively fine gauges. On the other hand, for larger gauges, it may be preferably for alternate needle holders to extend in the same direction from the needle plane.

Each needle holder is preferably provided with a support shaft which extends in the needle reciprocation direction and is slidably supported in the frame. The absence of the spring eliminates the friction which occurs in the prior art between the spring and shaft. This leads to an additional benefit that the shaft can be thicker than in the prior art meaning that it provides more stable support for the sliding needle holder.

Preferably each needle holder has two guide surfaces supporting opposite sides of a respective needle holder. This provides good torsional stability for the needle holders particularly in conjunction with the support shaft.

According to a second aspect of the present invention there is a provided a tufting machine according to claim 13.

This second aspect of the invention solves the problem of an individual needle holder potentially being fully aligned with a gap between adjacent magnet strips. This is explained in greater detail above.

An example of a tufting machine in accordance with the present invention will now be described with reference to the accompanying drawings, in which.

Most of the elements of the tufting machine are a traditional individual needle control machine such as that disclosed in GB2385604.

The elements of the tufting machine that are conventional will therefore not be described here in detail.

In particular, the yarn feed mechanism, the means for feeding the backing medium B through the tufting machine and the gauge parts provided beneath the backing medium B which pick up the yarns from the needles and form the loops or stitches are conventional and are not shown here.

Figure 1:
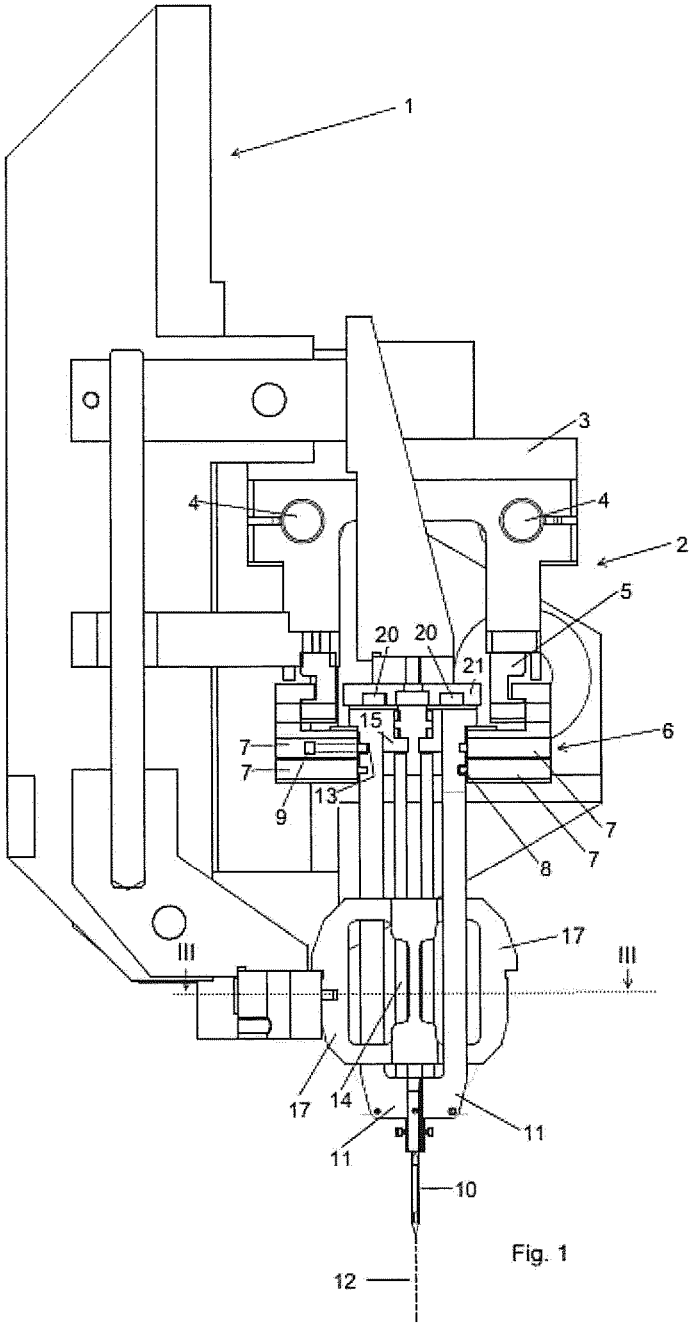
FIG. 1 is a cross sectional view of a machine showing a pair of needle holders in top dead centre position.
Figure 2:
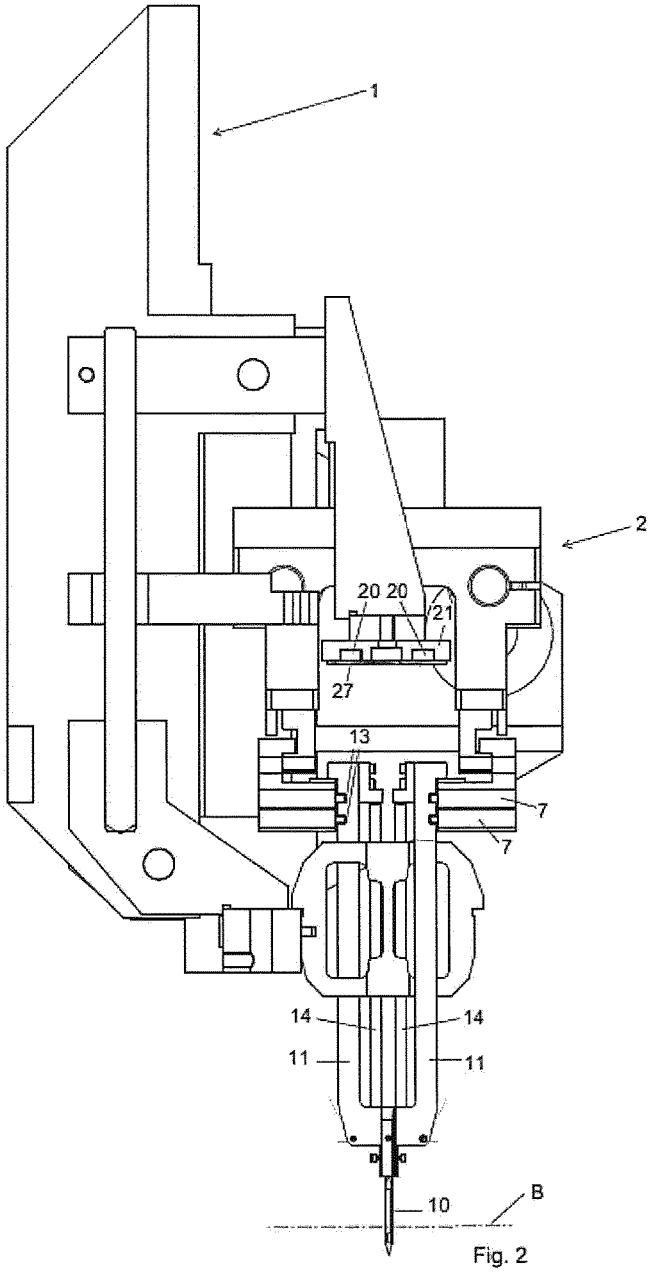
FIG. 2 is the same view with the needles in bottom dead centre position.

FIGS. 1 and 2 depict the mechanism for reciprocating and selecting the needles to be advanced into the backing medium B. FIGS. 1 and 2 depict the same components, the difference being that FIG. 1 shows the position of the components at top dead centre while FIG. 2 shows the components at bottom dead centre.

As shown in FIGS. 1 and 2, the tufting machine has a fixed support 1 and a movable carriage 2, the movable carriage being shown its upper most position in FIG. 1 and its lower most position in FIG. 2 as described in greater details below.

The movable carriage 2 has an upper yoke 3 which is slidable in a lateral direction (in and out of the plane of the page in the figures) on a pair of rails 4. The upper yoke 3 is connected to sliding needle bars 5 which it will move laterally in order to move the needles across the backing medium B. The whole movable carriage 2 is supported with relation to the fixed support 1 by a support which is out of the plane of FIGS. 1 and 2 which will allow the lateral and vertical motion described above. This is well known in individual needle control machines such as that disclosed in GB2385604.

Supported beneath the needle bars 5 is the needle selection mechanism 6 which is movable with the needle bar 5. The needle selection mechanism is in the form of a plurality of cylinders 7 from each of which an actuation rod 8 extends. Each cylinder 7 contains a piston 9 attached to the rod 8 and is pneumatically controlled such that the piston 9 can be moved to selectively extend and retract the actuation rod 8. Again, this is as described in GB2385604.

Figure 3:
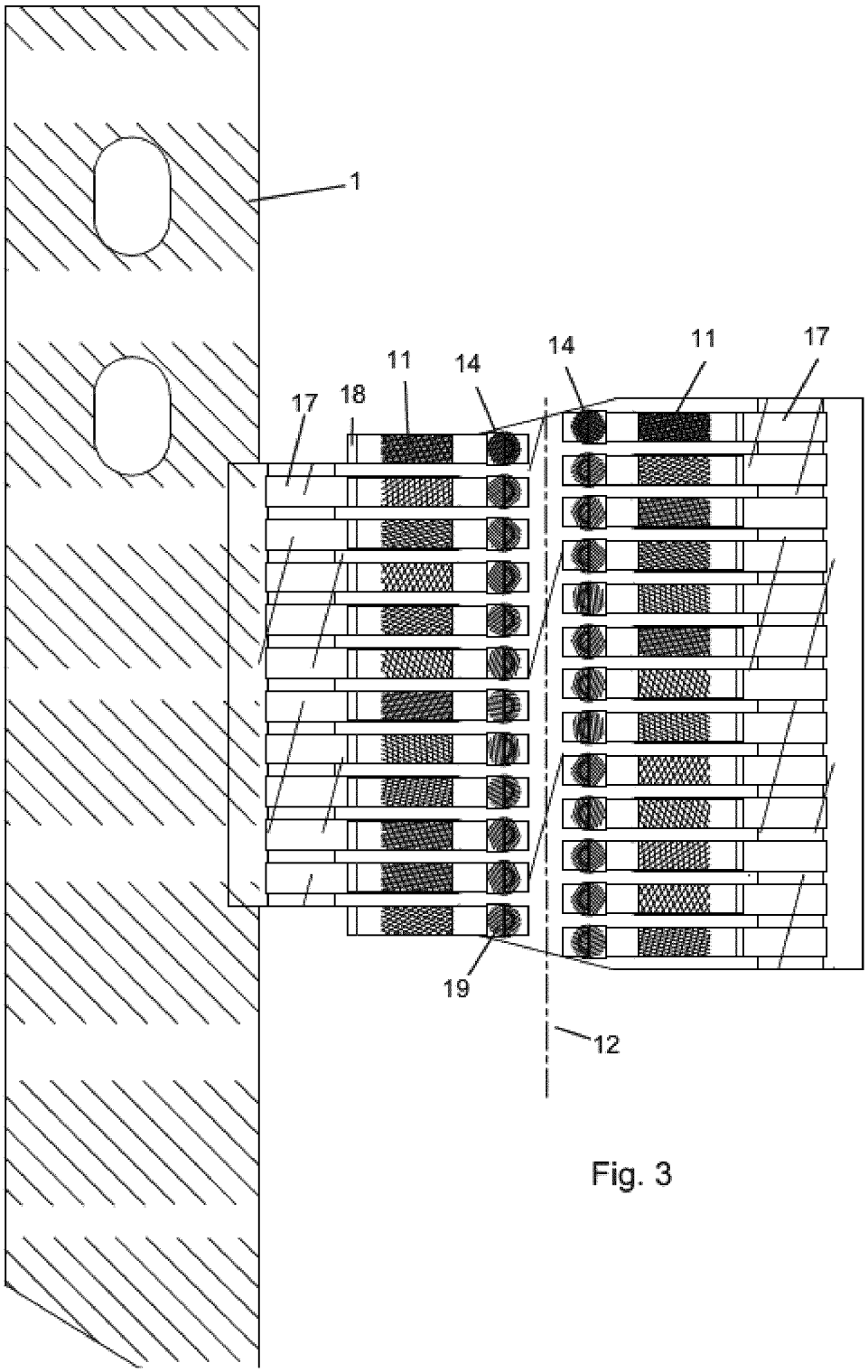
FIG. 3 is a section along line III-III in FIG. 1.

A needle 10 is mounted on each needle holder or needle support 11. The needle support 11 is a flat strip of material which extends from the needle 10 up into the vicinity of the cylinder 7. FIGS. 1 and 2 show a single needle 10. This is because the needles are aligned in a direction perpendicular to the plane of the paper of the figures. This is shown in FIG. 3.

In this case, the needle supports 11 extend in alternate directions with respect to a median plane 12 which contains the needles 10. Thus, the needle support 11 on the right hand side of FIG. 1 supports the needle 10 which is visible in the drawings and extends to the right of the plane 12. The needle support 11 shown on the left hand side in FIG. 1 supports the needle immediately behind the needle 10 and extends to the left of the median plane 12.

At the upper end of each needle support 11 are a pair of recesses 13. These are complimentary to the actuation rods 8 such that an extended actuated rod 8 will enter the recess 13 of the respective needle support 11.

The needle supports 11 shown in the drawings have a pair of recesses. However, only one of these is used for any particular needle support. The reason that two are provided is to allow the cylinders 7 to be arranged in a staggered relationship such that there is effectively an upper and lower row of cylinders 7 on each side. The upper row of cylinders 7 will engage with the upper notch 13 on alternate cylinders while the lower row of cylinders 7 engage with the lower notch 13 on alternate cylinders. For example, in FIG. 1, the lowermost cylinder 7 on the right hand side has an actuation rod 8 aligned with the lower most notch 13. The uppermost cylinder 7 on the right hand side will be aligned with the upper most notch 13 for the needle support (not shown) which is immediately behind the needle support 11 shown in FIG. 1. It is not necessary to have this staggered arrangement of cylinders if there is sufficient room to accommodate all of the cylinders 7 side by side. Similarly, it is not necessary to have two notches in each needle support 11 instead, they could be one set of needle supports 11 with upper notches and another with lower notches. However, this is much more difficult to assemble as the assembler then needs to choose the right needle support to fit with the cylinder.

As is well known in the art, the pattern data for the carpet requires a stitch of a certain colour to be present at a certain location within the pattern.

As the sliding needle bar moves across the backing material B, it selectively presents yarns of different colours at each position. When a controller determines that the colour being presented is required for the pattern, it activates the cylinder 7 thereby extending the actuator 13 such that the needle support 11 for the selected needle 10 is latched to the needle bars and will move down with the needle bar to form a stitch as the needle bar is reciprocated. It should be noted that it is not necessary for the needles to extend across the full width of the tufting machine. In some cases, if it is not required by the pattern of the carpet being formed, the needles 10 for unused stitch positions may not be present.

Each needle support 11 is attached to a shaft 14 (in the form of a cylindrical rod) by a bracket 15 at its uppermost end. At the bottom, the shaft 14 is firmly attached to the needle support 11 (e.g. by a press fit or by gluing). This provides added stiffness to the needle support 11 which is otherwise liable to deflect out of the plane of the paper in figures. The needle support 11 and shaft 14 are supported in a guide support 17 which is part of fixed support 11. As shown in FIG. 3 the guide support 17 is provided with a plurality of slots 18 and a plurality of holes 19 which support the needle supports 11 and shafts 14 respectively so that they can slide vertically as described above. This also provides good support against torsional forces.

Because no spring is required to surround the shaft 14, the shaft can have a larger diameter than it does in GB2385604. This provides improved stiffness to the needle support 11 and also provides a larger shaft which is supported in a larger opening such that torsional loads are better resisted, and any fractional contact between the shaft and the opening in which it reciprocates will be spread over a wider area thereby reducing heat generation and wear. Due to the elimination of the spring, the height of the guide support 17 can be increased, leading to even better resistance against torsional loads.

The main improvement concerns the manner in which the needle supports 11 are retained when they are not selected.

As mentioned above, when a needle is selected, the actuator rod 8 enters a recess 13 on the selected needle support 11 such that the needle 10 is moved down to bottom dead centre as shown in FIG. 2. At this time, however, all of the non-selected needles need to be retained in their top dead centre position as they are not reciprocated with the needle bar 5.

The retaining means must be reliable as, if a non-selected support 11 is not retained, it will move out of alignment with the actuator rod 8 and will therefore cease to function. On the other hand, it cannot be retained with a high retaining force as the force needs to be overcome when a needle is selected. Given the number of needles across the machine, this can place undue load on the motor driving the reciprocation of the needle bar.

This is done on the present case by a magnet 20 mounted to a stop bar 21 on the fixed support 1 at a location immediately above the uppermost edge of the needle support 11 in its top dead centre position.

As the needle support is only attracted to a magnet near the top dead centre position, and no spring force has to be overcome during the full length of travel of the needle support, the amount of power needed to reciprocate the needle bar is significantly decreased.

Figure 4:
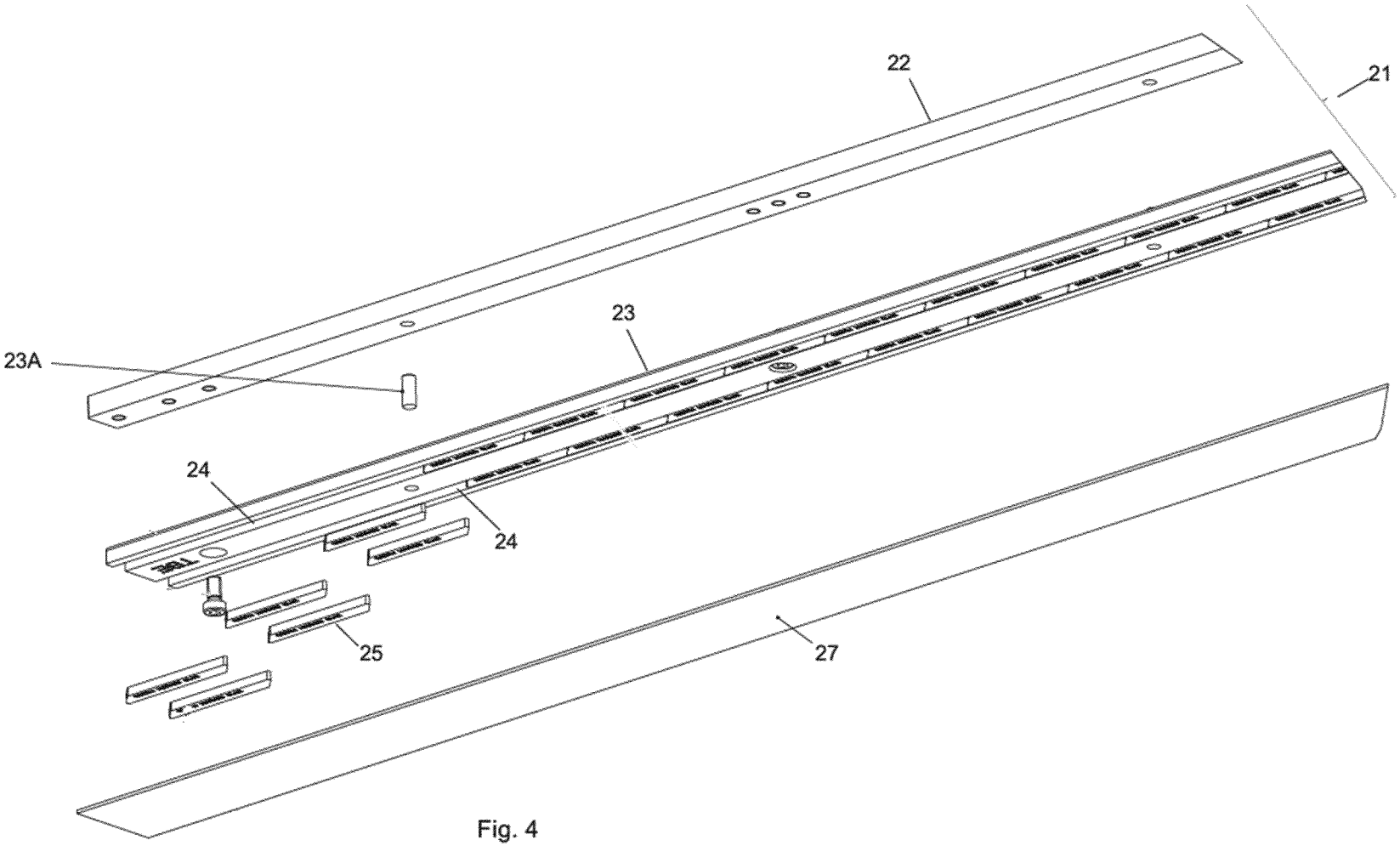
FIG. 4 is an exploded perspective view showing the stop bar.
Figure 5:
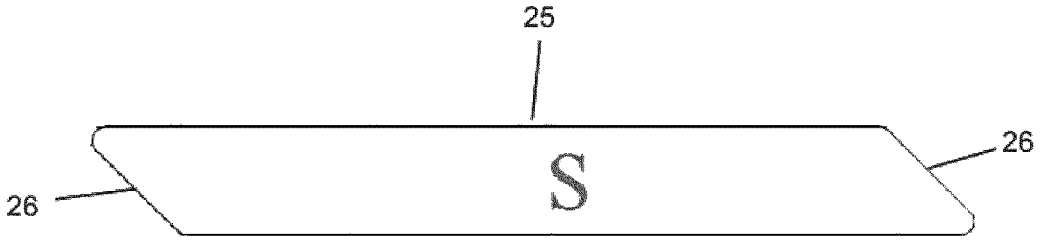
FIG. 5 is a plan view of a single magnet strip.
Figure 6:
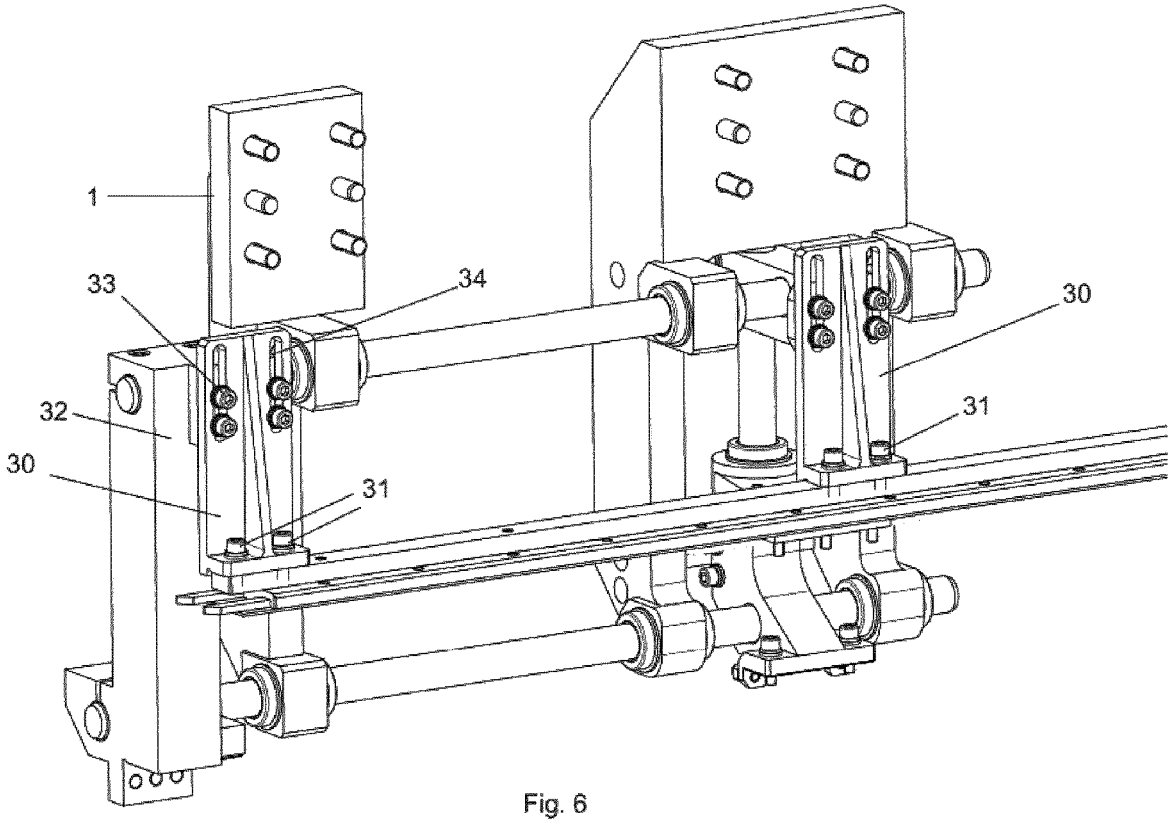
FIG. 6 is a perspective view of an upper portion of the tufting machine.

The manner in which the magnet 20 is mounted is shown in greater detail in FIGS. 4 to 6.

As shown in FIG. 4, the stop bar 21 is an elongate component which runs across the width of the tufting machine. A single bar may extend fully across the machine, or may be divided into a number of segments.

The stop bar 21 comprises an upper mounting portion 22 which is bolted to a lower magnet retaining portion 23 by bolts 23A only one of which is shown in FIG. 4.

The magnet retaining portion 23 has a pair of elongate grooves 24 each of which receives a row of magnetic strips 25 one of which is shown in FIG. 5.

As is apparent from this figure, each magnet strip 25 has a parallelogram shape with inclined end 26. When these are placed together in a respective groove 24 as shown in FIG. 4, the magnets are designed to abut one another. Although some gaps may appear between adjacent strips, the inclined faces 26 ensure that, even if there is a gap, at any position across the tufting machine, there will always be magnet material present immediately above each of the needle supports 11.

The magnet strips 25 may be an interference fit in respective grooves 24, or may be fastened more securely by an adhesive from mechanical fastening.

In addition, a rubber pad 27 is adhered across the lower face of the stop bar 21 in order to cover the magnets and to provide cushioning for the magnets. The pad 27 may be of any suitable cushioning material. Further, it may not be a single pad as shown in FIG. 4, but it could, instead, be a pair of pads running in parallel one covering each groove 24, or may be otherwise divided into separate parts.

The manner in which the stop bar 21 is attached to the support 1 is shown in FIG. 6.

A number of flanged brackets 30 are bolted at bolts 31 between the top of the mounting component 22. The upper part of the flange bracket 30 is bolted to a vertical face 32 which is fixed with respect the fixed support 1.

A number of bolts 33 as shown in FIG. 6, are retained in vertical grooves 34 allowing for adjustment of the height of the stop bar 21 in order to accommodate a change in stroke of the tufting machine. This provides a robust way of adjusting the height of the stop bar 21 which ensures that uniformed adjustment is applied both rows of magnets 25 evenly.

The needle support 11 is made of a ferromagnetic material or at least contains a ferromagnetic material towards it upper end so that it is attracted by the magnet 20.

A layer of cushioning material such as a rubber pad 27 covers the magnets 20 to reduce any impact force between the needle support 11 and magnets 20 as the needle support 11 reaches top dead centre.

Now, when a needle support 11 is not selected, the respective actuator rod 8 will not enter the recess 13 such that there is nothing to move the needle support 11 and associated needle to the bottom dead centre position. As a result, the needle support 11 will remain in the position shown in FIG. 1 because of the attraction between the magnet 20 and the needle support 11 while the selected needles move through a stroke via the bottom dead centre position of FIG. 2 and back. When the movable carriage 2 returns to the top dead centre position of FIG. 1, the system controller will again select the needles required for the next stroke, during which time the sliding needle bar 5 will have moved laterally with respect to the previous stroke. The appropriate actuator rods 8 are either left in place (if forming two stitches in a row), are retracted (if used with a previous stitch but not required for the current stitch) or are extended (if not used for the previous stitch but required for the current stitch) and the next stroke proceeds as set out above.

While the invention has been described where all of the needle bars are held by a magnetic coupling, there is no need for all of the needles to be held in this way. It could be the case that only some of the needles are held in this way while others are held conventionally. For example, it is possible that some conventional needle selection mechanisms which are worn or damaged are replaced by mechanisms as described above.

The invention claimed is:

1. A tufting machine comprising:

a needle bar reciprocable in a needle reciprocation direction substantially perpendicular to a direction in which a backing material is fed through the machine;

a plurality of needle holders associated with the needle bar and slidably supported in a frame for reciprocation in the needle reciprocation direction, a respective needle attached to each needle holder, each needle holder having an engagement portion, wherein the needle bar selectively latches with the engagement portion of each selected needle holder so as to selectively drive latched needle holders in the needle reciprocation direction;

a stop bar positioned to limit the upward movement of the needle holders; and at least one magnet which retains non-latched needle holders in its uppermost position as the needle bar is reciprocated;

wherein each magnet is embedded in the stop bar, and a cushioning member is attached to the magnet and faces the top of each needle holder.

2. The tufting machine according to claim 1, wherein each magnet is provided by a plurality of elongate strips arranged end to end.

3. The tufting machine according to claim 2, wherein at least one end of at least one strip is arranged at least partially outside a plane parallel to both the direction in which the backing material is fed through the machine and the needle reciprocation direction and wherein an adjacent end of an adjacent strip has a complementary configuration.

4. The tufting machine according to claim 3, wherein each of the elongate strips is the same shape.

5. The tufting machine according to claim 1, wherein the surface of each magnet is flush with the surface of the stop bar.

6. The tufting machine according to claim 1, wherein the needle holders are arranged in two rows, and the stop bar spans the two rows.

7. The tufting machine according to claim 1, wherein the needles are arranged in a line defining a needle plane and wherein alternate needle holders extend in opposite directions from the needle plane.

8. The tufting machine according to claim 1, wherein the needles are arranged in a line defining a needle plane and wherein alternate needle holders extend in the same direction from the needle plane.

9. The tufting machine according to claim 1, wherein each needle holder is provided with a support shaft which extends in the needle reciprocation direction and is slidably supported in the frame.

10. The tufting machine according to claim 1, wherein each needle holder has two guide surfaces each supported by a guide support.

11. The tufting machine according to claim 1, wherein there are a plurality of magnets and each needle holder is associated with a respective magnet.

12. The tufting machine according claim 1, wherein each magnet is associated with a plurality of needle holders.

* * * * *